US005273374A

United States Patent [19]

Thoma et al.

[11] Patent Number: 5,273,374

[45] Date of Patent: Dec. 28, 1993

[54] DOWEL SETTING DEVICE

[76] Inventors: Erhard Thoma, Grabenstr. 89, D-7034 Gartringen; Michael Weinberger, Carossastr. 21, D-8358 Vilshofen 4, both of Fed. Rep. of Germany

[21] Appl. No.: 784,399

[22] PCT Filed: Mar. 27, 1991

[86] PCT No.: PCT/FP91/00600

§ 371 Date: Dec. 30, 1991
§ 102e Date: Dec. 30, 1991

[87] PCT Pub. No.: WO91/17314
PCT Pub. Date: Nov. 14, 1991

[30] Foreign Application Priority Data

May 2, 1990 [DE] Fed. Rep. of Germany ..... 4014098

[51] Int. Cl.[5] ..... E01C 23/04
[52] U.S. Cl. ..... 404/88; 404/100
[58] Field of Search ..... 404/88, 101, 100, 102, 404/108

[56] References Cited

U.S. PATENT DOCUMENTS

| | | | |
|---|---|---|---|
| 2,295,947 | 9/1942 | Heltzel | 404/88 |
| 4,493,584 | 1/1985 | Guntert | 404/100 |
| 4,799,820 | 1/1989 | Laeuppi et al. | 404/100 |
| 4,995,758 | 2/1991 | Smith | 404/88 |

*Primary Examiner*—Ramon S. Britts
*Assistant Examiner*—Nancy P. Connolly
*Attorney, Agent, or Firm*—Jones, Tullar & Cooper

[57] ABSTRACT

A dowel setting device which can be employed together with a formless paving machine is described. A plurality of booms is pivotably disposed, looking in the direction of travel, ahead of the vehicle body and ahead of devices for tamping the concrete. Dowel retrievers are located at the ends of the booms. In a loading position, the dowel retrievers retrieve dowels from a magazine. Following a pivot movement, the dowel retrievers assume a setting position in which they extend, looking in the direction of travel, from the front into the area where the concrete is beginning to set. The dowels are ejected.

10 Claims, 5 Drawing Sheets

DOWEL SETTING DEVICE

BACKGROUND OF THE INVENTION

The invention relates to a dowel setting device for use with a formless paving machine, where a plurality of booms in the form of dowel retrievers are disposed ahead of the devices for compacting the concrete, where the dowel retrievers retrieve dowels from a magazine and extend, looking in the direction of travel, from the front into the area of beginning compacting of the concrete parallel to the direction of travel and eject the dowel there.

A dowel setting device of this type is known from DE-OS 22 59 040. Although this dowel setting device is distinguished by a comparatively simple structure, this must be paid for with a disadvantage which in actuality cannot be disregarded. In accordance with FIG. 1 in the drawings of this pre-publication, the support 10 of this dowel setting device is continuously being pushed through the loose concrete piled up in front of the formless paving machine. As a result it yields laterally and it is necessary to return it, in a manner not described into the space between the support of the dowel setting device and the guide plate 11 of the formless paving machine. This support 10 furthermore hampers the discharge of concrete ahead of the formless paving machine, i.e. it is not possible to dump the concrete directly in front of the guide plate or the like of the formless paving machine.

As is known, the formless paving machine produces concrete surfaces such as streets, concrete roads and the like in a continuous movement. Liquid concrete, i.e., concrete that has not yet hardened, is loosely piled in front of the machine from trucks. It is then distributed by a distributor screw, which is disposed crosswise to the direction of travel, and is subsequently compacted and smoothed by a vibrator and a pressure tamper following it. Then the dowel setting device places dowels into the not yet hardened concrete at preset distances in rows parallel to the direction of travel. After the concrete has set a little, grooves are cut at this place crosswise to the dowels. Upon further hardening of the concrete, the concrete cover breaks at these places. Because of this, individual concrete slabs are created which are separated from each other but fixed in relation to each other by the previously pressed-in dowels. The dowels prevent the offset of these these concrete slabs from each other in height and form barriers.

If, instead of inserting the dowels behind the formless paving machine, they are inserted into the not yet hardened concrete ahead of the formless paving machine in accordance with the previously known dowel setting device, an advantage is achieved that in this case the concrete has not yet hardened 100% and the surface has not been finally smoothed. Thus, dowel setting does not require any after-treatment of the concrete surface the way it does with dowel setting devices which are disposed, looking in the direction of travel, behind the formless paving machine.

Dowel setting devices disposed behind the formless paving machine do have the advantage that they do not hamper the dumping of the concrete ahead of the formless paving machine. However, as stated before, they require extensive after-treatment.

SUMMARY OF THE INVENTION

It is therefore an object of the invention to provide a dowel setting device for use with a formless paving machine, where a plurality of booms in the form of dowel retrieves are disposed ahead of the devices for compacting the concrete, where the dowel retrievers retrieve dowels from a magazine and extend, looking in the direction of travel, from the front into the area of beginning compacting of the concrete parallel to he direction of travel and eject the dowel there, and further in such a way that it is possible to insert the dowels, looking in the direction of travel of the formless paving machine, ahead of the latter into the concrete without hampering the laying of concrete in front of the formless paving machine.

To attain this object it is proposed in accordance with the invention to embody the dowel setting device in that the booms are pivotably disposed ahead of the vehicle body in the direction of travel, that the dowel retrievers are located at the end of the booms and that they, starting from an upwardly pivoted loading position, eject the dowels in a setting position attained after a pivotal movement. Because this dowel setting device or its dowel retrievers are always pivoted into the work area ahead of the formless paving machine for only a short time and because after setting the dowels, they are immediately pivoted upwards into a loading position, the work area ahead of the formless paving machine is freely accessible for spreading the concrete during a large part of the working period. It is possible to coordinate the spreading of the concrete and the setting of the dowels in such a way that dowel setting does not hamper the spreading of the concrete at all.

Operation of the dowel setting device is no more difficult and the work expenditure no less than with the known dowel setting device. The same is true for the expenditure of work and energy when inserting the dowels into the concrete. The dowels can still be exactly positioned. No after-treatment for purposes of smoothing is necessary. For this reason no finishing beam is required behind the formless paving machine for this dowel setting device, either. On the other hand, the dowel setting device is distinguished by a short, compact design. Furthermore, the known direction of travel when inserting the dowels has the advantage that the distribution of the concrete grain over the dowel is not disturbed. The distances between the dowels can be freely selected by means of an appropriate choice of the structural disposition of the individual components (dowel retrievers) in respect to each other. Insertion of the dowels into the concrete takes place along a special curved form, where the concrete is already in motion at this point because of the vibrators. Retrieval of the dowels from the dowel retrievers takes place in a known manner at exactly the place where the energy intake of the concrete by means of vibrators ends, i.e. were the concrete takes up a final position and the setting process begins. Control and expansion of the device are particularly simple.

BRIEF DESCRIPTION OF THE DRAWINGS

An exemplary embodiment of the invention and of its advantageous further embodiments will be described below in detail, making reference to the, drawings.

FIG. 4 corresponds to the area IV of FIG. 1;

DESCRIPTION OF THE PREFERRED EMBODIMENTS

Figure 1:
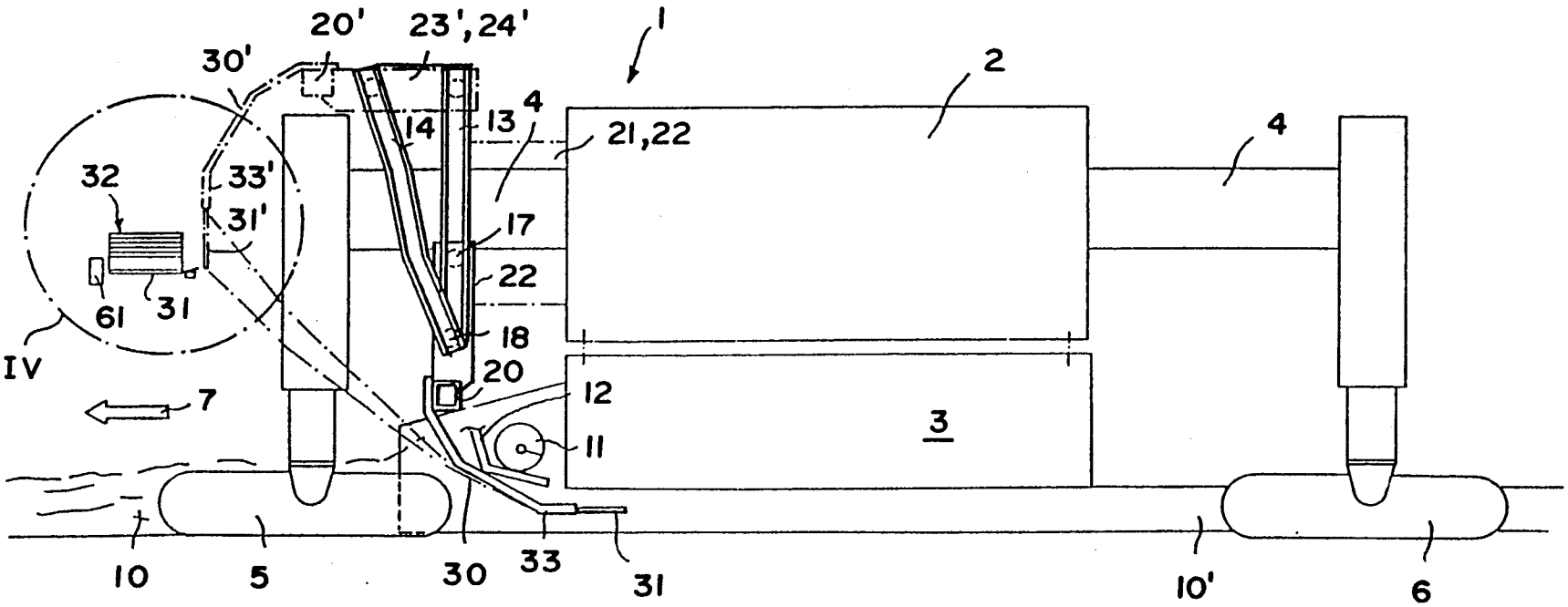
FIG. 1 illustrates schematically a dowel setter in accordance with an exemplary embodiment behind a formless paving machine.

FIG. 1 schematically shows—by thin lines—a formless paving machine 1, consisting of a vehicle body 2, a press beam 3, a frame 4 and moving tracks 5, 6 disposed thereon. The formless paving machine 1 moves in the direction of the arrow 7. Concrete is loosely dumped in front of the machine, is evenly distributed over the width of the roadway to be concreted by a distributing screw 11, is compacted by vibrators 12 and further tamped down and provided with a smooth surface by the press beam 3. The laid finished concrete 10′ is left behind the formless paving machine 1.

The vehicle body 2 supports guide sections 13, 14 and 15, 16 on both sides on booms 21, 22 (see FIG. 2), which are only suggested in FIG. 1. In these guide sections run rollers 17, 18, fastened on plates 23, 24 which are, in turn, connected with a support 20. If the support 20 is displaced in a vertical direction, it not only changes its position in respect to height but, since the roller 17 runs in the guide section 13 and the roller 18 in the guide section 14 (or the guide sections 15, 16), also in such a way that in its topmost position it takes up the position 20′, shown by dash-dot lines. The plates then take up the position 23′.

The height displacement of the support 20 takes place by means of a hydraulically-driven chain drive. For reasons of clarity details have been omitted from FIG. 1. However, one skilled in the art knows how to dispose such installations.

Figure 2:
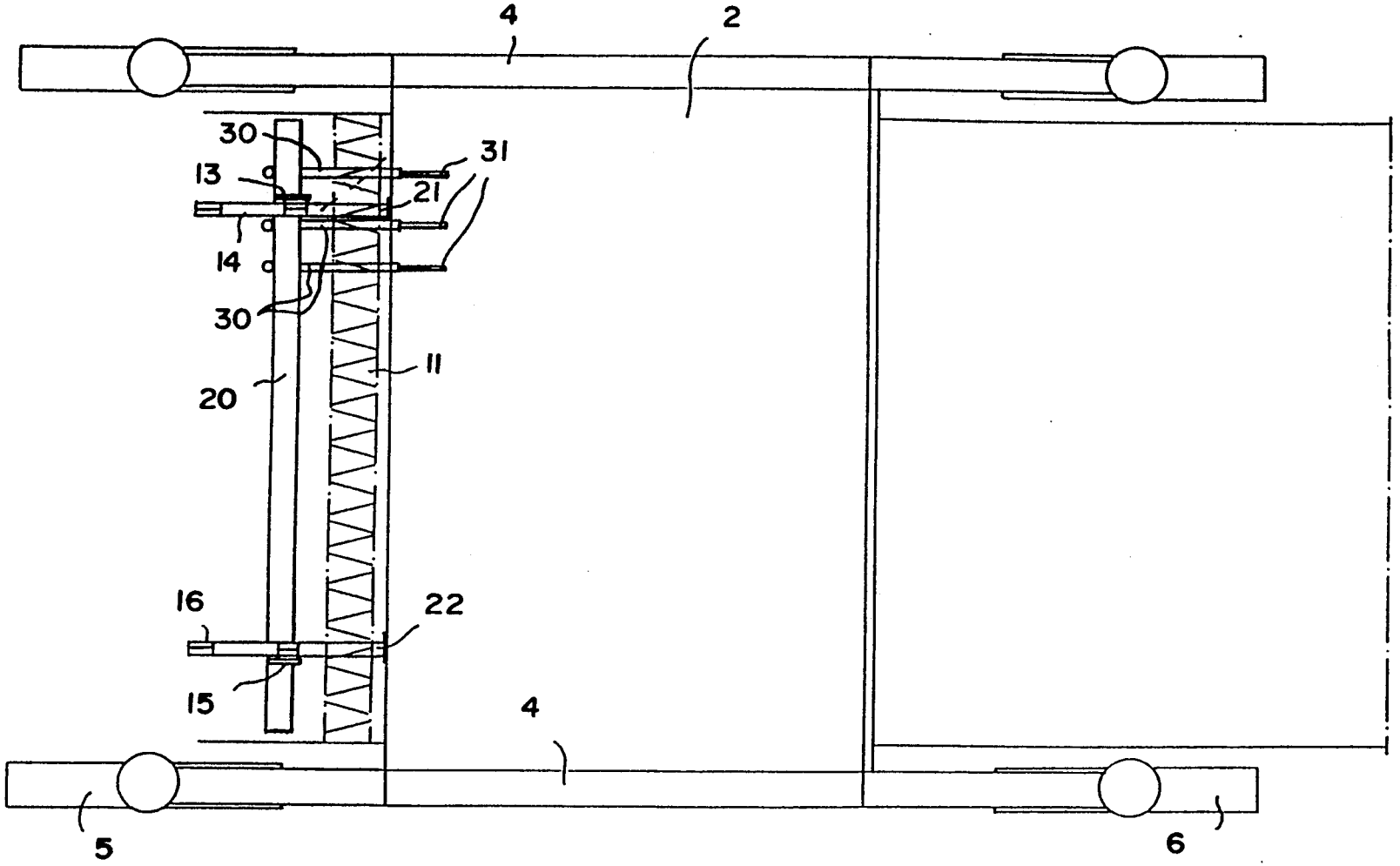
FIG. 2 is a top view of FIG. 1.

A plurality of booms 30 are disposed on the support 20, which are displaced out of the setting position shown in solid lines in FIG. 1 into the loading position 30′ shown in dash-dot lines when the support 20 is displaced in height. In the loading position 30′ the booms 30 receive dowels 31 in their ends, which are provided by a magazine 32. The position of a dowel 31 in the boom in its loading position 30′ is indicated by 31′. The insertion of the dowel 31 into the not completely set concrete in the front area of the formless paving machine 1 takes place by lowering of the support 20 into the setting position indicated by solid lines in FIG. 1. In this position the dowels 31 are ejected from the boom 30 and remain in their position. The formless paving machine 1 and the booms 30 along with it move on in the direction of the arrow 7. The formless paving machine 1 moves over the concrete which is still liquid (soft) but increasingly undergoes compacting and setting. The dowel 31 does not change its position in it anymore. As shown in FIG. 2, a row of approximately 20 dowels lies in the concrete next to each other. A groove is cut crosswise into the already set but not finally hardened and dried concrete approximately 50 to 80 meters behind the formless paving machine 1. However, this indication of the distance should not be considered to be limiting. The distance in time is decisive; it depends on the temperature and the composition of the concrete and may lie between a few hours and two days. In the course of the continued hardening process in the concrete, the concrete layer rips along the groove, so that several adjacent plates are created which are connected with each other via the dowels 31.

Figure 3:
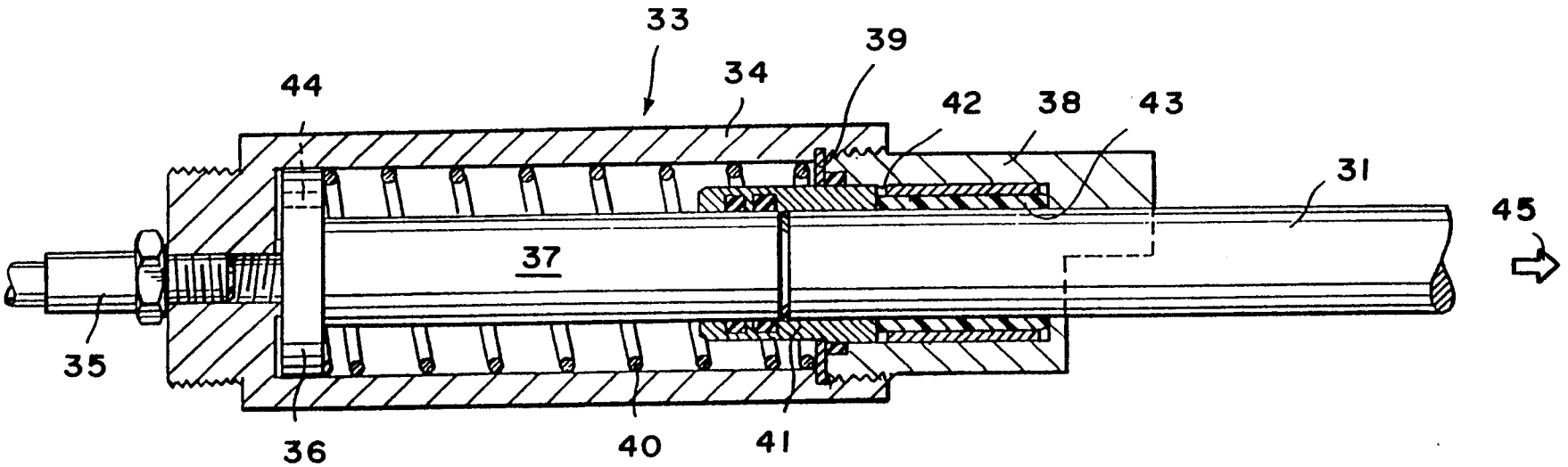
FIG. 3 illustrates a dowel at the end of dowel retriever.

Retrieval of the dowels 31 by the booms 30 takes place by means of the dowel retrievers 33 shown in FIG. 3, which are disposed or provided at the end of the booms 30.

The dowel retriever 33 has a cylinder 34, which is screwed into the boom 30 with its left end and can be charged with pressure by a hydraulic medium via a connector 35 (FIG. 3). A piston 36 is displaceable in the cylinder 34 and is connected with a tappet 37. A dowel retrieval sleeve 38 is screwed into the end of the cylinder 34. Between the cylinder 34 and the dowel retrieval sleeve 38 a disk 39 is located, on which a spring 40 is supported which pushes the piston 36 downward and to the left as shown in FIG. 3. A guide sleeve 41 is disposed in the dowel retrieval sleeve 38, which has slits 42 in which neoprene inserts 43 are disposed. Once a dowel 31 has been received in a guide sleeve 41 in the manner shown, it is held, with the neoprene inserts 43 appropriately sized, in such a way that the latter are slightly pressed together (in a radial direction towards the outside) when the dowel is inserted. This can furthermore be assisted in that, when the the connector 35 is charged with slight pressure which is also propagated through the opening 44 in the piston 36 into the interior of the cylinder 34, the guide sleeve 34 presses in an axial direction on the neoprene inserts 43 and in this way slightly widens them radially. If the pressure at the connector 35 is increased, however, the piston 36 is displaced towards the right against the force of the spring 40 and pushes the dowel 31 in the axial direction out of the dowel retrieval sleeve 38 or the guide sleeve 41 in the direction of the arrow 45. This action takes place in the setting position (see FIG. 1).

Figure 4:
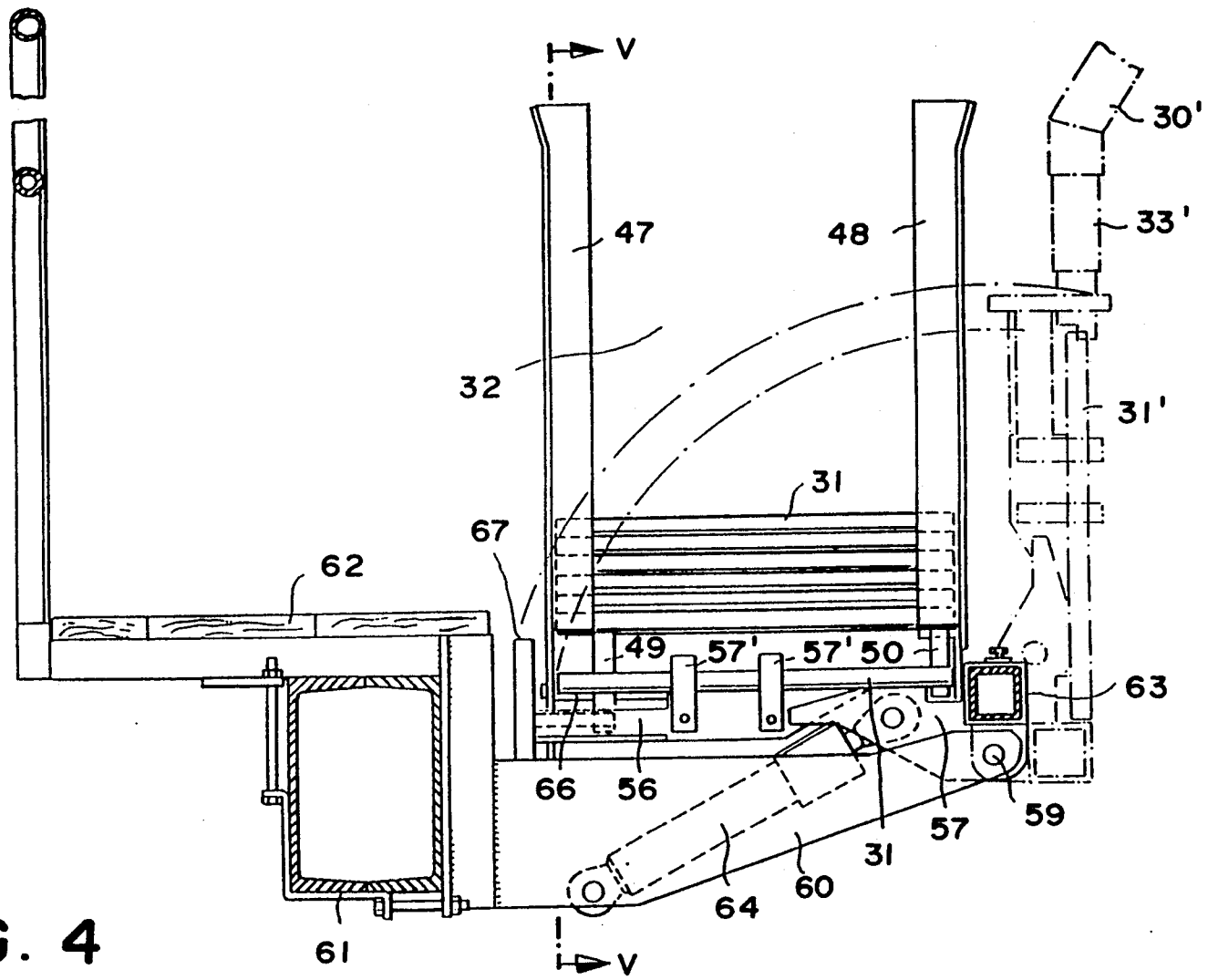
FIG. 4 illustrates magazine of the dowel setter in accordance with FIG. 1 with the devices for loading the dowels.
Figure 5:
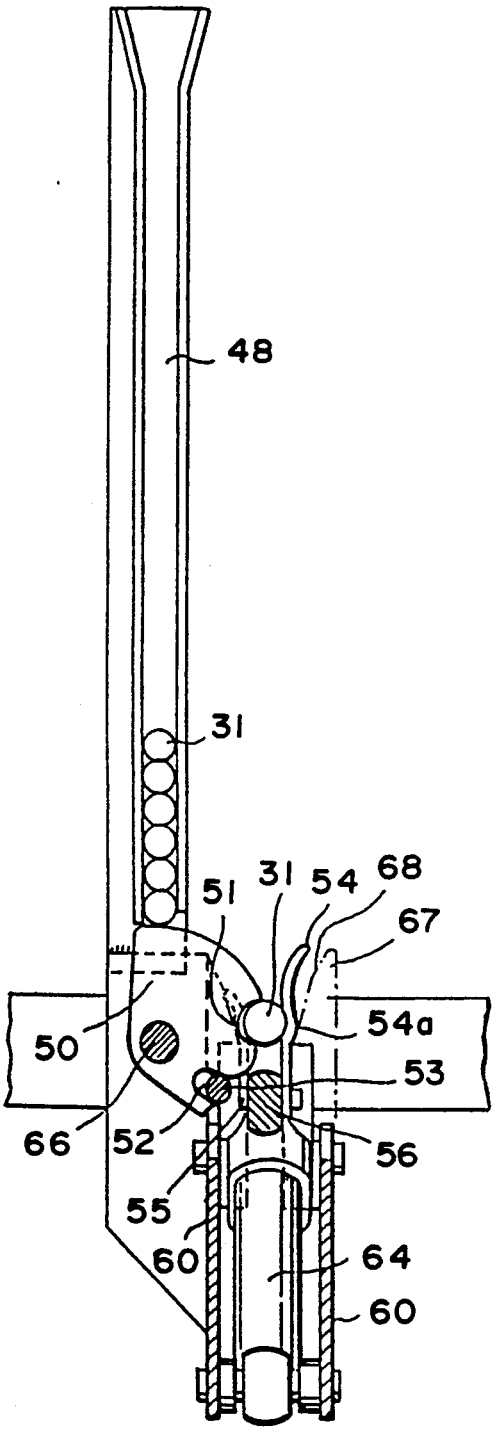
FIG. 5 is a section along the line V—V of FIG. 4.
Figure 6:
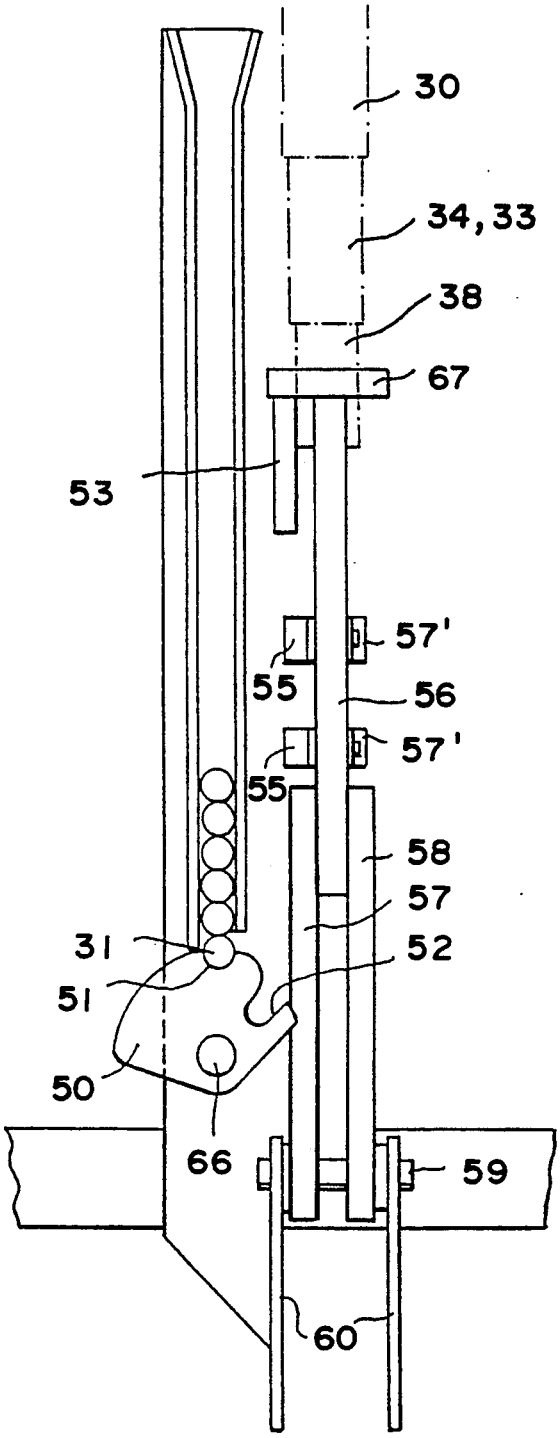
FIG. 6 is an illustration in accordance with FIG. 5, with various parts being left off, in the upright position of a pivoting beam.

The action of loading the dowel retriever 33, which in FIG. 1 is shown in the loading position 33′, can be seen in detail in FIGS. 4 to 6. A number of devices which are shown there have been left out in FIG. 1 for the sake of clarity.

In FIG. 6 the boom 30 is also in its loading position 30′, the dowel retriever in its position 33′, the dowel in its position 31′.

The magazine 32 is formed by two U-shaped rails 47, 48, into which the dowels 31 are inserted from above. Cam plates 49, 50 are disposed on the underside of the shaped rails 47, 48 and are slightly offset towards the inside in respect to them. They prevent the dowels from falling out. Both cam plates have a dowel retrieval groove 51; furthermore, the cam plate 49 has a switching groove 52. In the position shown in FIG. 6, the dowel retrieval groove 51 receives a dowel 31 at the lower end of the shaft formed by the U-shaped rails 47, 48. If now the cam plates 49, 50 are rotated because of the engagement of a switching finger 53 in the switching groove 52, the shaft formed by the U-shaped rails 47, 48 is closed at the bottom and simultaneously the dowel 31 is brought into a position in which, as shown in FIG. 5, it is clamped between leaf springs 54 and a guide plate 55. As can be seen, the leaf springs 54 and 54*a* are slightly rounded so that at this point the dowel 31 is resiliently fixed in a defined position between the guide plate 55 and the leaf spring 54. As shown in FIG. 4, the leaf springs 54 have been provided twice at a distance and are bolted to a pivot beam 56. On its left side (in FIG. 4), this pivot beam 56 has two centering plates 57' and is welded with its right side to plates 57, 58, which are rotatably fastened by means of a shaft 59 to the boom 60 which is solidly fastened on the machine by means of a mounting support 61. A bearing surface 62 is located above the mounting support 61, from where the magazine 32 can be supplied with dowels 31. A square tube 63 is also welded to the plates 57, 58. Pivoting of the pivot beam 56 in respect to the boom 60 takes place by means of a hydraulically operable cylinder/piston arrangement 64. The cam plates 49, 50 are rotatable around the shaft 66. They are provided with the lower outer face portion of the U-shaped rails 47, 48.

If the cam plates 49, 50 are in the position shown in FIG. 6, and if the pivot lever 56 is downwardly pivoted from the upright position shown in FIG. 6 (which is shown dash-dotted in FIG. 4), the switching finger 53 engages the switching groove 52 of the cam plates 49, 50 and in this way rotates the cam plates into the position shown in FIG. 5. In this way one dowel 31 is pushed into the clamped position between the guide plate 55 and the leaf springs 54. If the pivot beam 56 is pivoted upwards again, the centering disk 67, which has a centering groove 68 for this purpose, centers itself on the dowel retrieval sleeve 38 (see FIG. 6). In FIG. 6 the centering disk 67 is drawn by dash-dot lines, because as a result of the position of the section V—V it is located ahead of the drawing plane. This is achieved in that the groove grips the dowel retrieval sleeve 38 practically like a fork, so that the latter is used as a stop at the same time. In this situation the downward movement of the support 20 with the booms 30 disposed on it out of the position 30' (FIG. 1) starts. In the first phase the dowel retrieval sleeve 38 is pushed over the upper end of the dowel 31 in the position 31' shown in FIG. 4. The dowel 31 rests on the square tube 63 for retrieval. Following retrieval the pivot beam with the square tube 63 is pivoted back and, with continued downward movement of the support 20 along the coupler curves drawn in somewhat heavier dash-dot lines in FIG. 1, is moved downward far enough so that the dowel 31 is in the setting position shown by solid lines in FIG. 1 at the end of the pivot movement. The the connector 35 (see FIG. 3) is charged with pressure, so that the dowel is ejected. As already described, it is in its final position at that time.

We claim:

1. A dowel setting device used with a formless paving machine, the formless paving machine including a vehicle body, a press beam, a concrete distributing screw and vibrators, the vibrators serving to compact the concrete distributed by the concrete distributing screw, and the press beam serving to further tamp down the concrete distributed by the concrete distributing screw, the dowel setting device comprising:

a plurality of booms each having a mounting end and a free end;

a dowel retriever means mounted at the free end of each boom; and mounting means to which the mounting end of each boom is mounted, said mounting means mounting said plurality of booms so that they extend across the front of the formless paving machine, viewed in the direction of concrete distribution, said mounting means adapted to pivot the booms and their respective dowel retriever means from a loading position where dowels are retrieved from a dowel supply means to a setting position where the loaded dowels are ejected by said dowel retriever means into the compacted and tamped down concrete.

2. The dowel setting device as defined in claim 1, wherein said mounting means includes a beam support which extends across the front of the formless paving machine, and on which said plurality of booms are mounted at their mounting ends.

3. The dowel setting device as defined in claim 1, wherein said mounting means further includes guide sections mounted to the vehicle body on each side thereof, viewed in the direction transverse to the direction of concrete distribution, said guide sections defining guide rails, and a mounting plate mounted on each end of said beam support, each mounting plate having a roller which is guided by a respective guide rail, said rollers moving in their respective guide rails to guide said beam support between the loading position and the setting position.

4. The dowel setting device as defined in claim 1, wherein in the setting position each boom is inclined obliquely relative to the distributed concrete.

5. The dowel setting device as defined in claim 1, wherein each dowel retriever means includes a cylinder, a dowel retrieval sleeve mounted to one end of said cylinder, a piston and a tappet connected to the piston and displaceable therewith in said cylinder, said tappet serving to eject a dowel held by said dowel retrieving sleeve.

6. The dowel setting device as defined in claim 5, wherein each dowel retriever means further includes neoprene inserts for holding a dowel in said dowel retrieval sleeve.

7. The dowel setting device as defined in claim 1, further comprising:

a dowel magazine assembly forming the dowel supply means, said magazine assembly including a pivot beam having clamping elements, cam plates and a pair of spaced apart rail sections opened at one end through which dowels are placed between the rails, and closed at their other end by said cam plates, each cam plate having a dowel retrieval groove which receives a dowel, said cam plates being pivotably mounted so that a dowel can be moved from said rail sections for reception by said clamping elements.

8. The dowel setting device as defined in claim 7, wherein said pivot beam is adapted to be pivoted from a first position in which it receives a dowel from said cam plates to a second position where the dowel is retrieved by a respective dowel retriever means.

9. The dowel setting device as defined in claim 7, wherein said dowel magazine assembly further includes a switching finger disposed on said pivot beam, and a switching groove provided in each cam plate, wherein rotation of the cam plates takes place by the engagement of the switching finger with the switching groove.

10. The dowel setting device as defined in claim 9, wherein the pivot beam includes a centering plate with a centering groove at its free end, wherein each dowel retriever means includes a stop, and wherein said centering plate is movable as far as said stop where centering takes place by the engagement of the centering groove with said dowel retriever means.

* * * * *